US005878816A

United States Patent [19]

Lalor et al.

[11] Patent Number: 5,878,816

[45] Date of Patent: Mar. 9, 1999

[54] ADJUSTABLE CASING HANGER

[75] Inventors: Richard C. Lalor, Tomball; Russell E. McBeth, The Woodlands; Amrik S. Nijjar; Kenneth G. Rountree, both of Houston, all of Tex.

[73] Assignee: FMC Corporation, Chicago, Ill.

[21] Appl. No.: 853,004

[22] Filed: May 9, 1997

[51] Int. Cl.[6] ..... E21B 34/02

[52] U.S. Cl. ..... 166/348; 166/88.3; 166/360; 166/368; 166/382; 166/203

[58] Field of Search ..... 166/208, 88.3, 166/360, 368, 348, 382

[56] References Cited

U.S. PATENT DOCUMENTS

| | | | |
|---|---|---|---|
| 4,653,589 | 3/1987 | Alandy | 166/382 |
| 4,726,425 | 2/1988 | Smith | 166/208 X |
| 4,736,799 | 4/1988 | Ahlstone | 166/208 X |
| 4,742,874 | 5/1988 | Gullion | 166/208 X |
| 5,439,061 | 8/1995 | Brammer et al. | 166/368 |
| 5,653,289 | 8/1997 | Hosie et al. | 166/348 |

*Primary Examiner*—Roger Schoeppel
*Attorney, Agent, or Firm*—Henry C. Query, Jr.

[57] ABSTRACT

An adjustable casing hanger for suspending a casing string from a wellhead is provided which includes an elongated tubular body having a lower end adapted to be connected to the casing string and an upper end portion including a plurality of axial annular grooves formed in the outer diameter surface thereof, each groove defining a downwardly facing support surface, and a support ring adapted to be positioned around the body in one of the grooves, the support ring having an upwardly facing load shoulder for engaging the support surface and a downwardly facing load surface for engaging a support shoulder formed in the wellhead, whereby the elevation of the casing hanger within the wellhead can be adjusted depending on in which groove the support ring is positioned. If desired or required by a particular application, one or more seals may be provided for sealing the annulus between the casing hanger and the wellhead, in which event the casing hanger preferably further includes a sealing surface pre-machined into each groove for engaging the seals.

7 Claims, 2 Drawing Sheets

ADJUSTABLE CASING HANGER

BACKGROUND OF THE INVENTION

The present invention relates to a well casing hanger and, more particularly, to an adjustable casing hanger for adjustably suspending a tieback casing string which is connected to a subsea wellhead from a surface wellhead located on a offshore drilling or completion rig.

A tieback casing string is generally required in offshore petroleum production installations to provide a fluid conduit between a subsea wellhead and a surface wellhead located on an offshore drilling or completion rig. An adjustable casing hanger is typically used to space out the tieback casing string between these two components. Heretofore, adjustable mandrel-type casing hangers have been used for this purpose. Prior art mandrel-type casing hangers generally comprise a first tubular member which is connected to the tieback casing string and a second tubular member which includes a support surface for engaging a support shoulder formed in the surface wellhead. The first and second tubular members are movably connected to vary the distance between the tieback casing string and the surface wellhead.

SUMMARY OF THE INVENTION

In accordance with the present invention, an adjustable casing hanger for suspending a casing string from a wellhead is provided which comprises an elongated tubular body having a lower end adapted to be connected to the casing string and an upper end portion comprising a plurality of axial annular grooves formed in the outer diameter surface thereof, each groove defining a downwardly facing support surface, and a support ring adapted to be positioned around the body in one of the grooves, the support ring having an upwardly facing load shoulder for engaging the support surface and a downwardly facing load surface for engaging a support shoulder formed in the wellhead, whereby the elevation of the casing hanger within the wellhead can be adjusted depending on in which groove the support ring is positioned. If desired or required by a particular application, one or more seals may be provided for sealing the annulus between the casing hanger and the wellhead, in which event the casing hanger preferably further comprises a sealing surface pre-machined into each groove for engaging the seals.

During installation of the adjustable casing hanger of the present invention, the casing hanger is made up to the top of the tieback casing string and the assembly is lowered through the surface wellhead until the bottom of the tieback casing string engages and connects to the subsea casing string which is suspended within the subsea well. The blowout preventer (BOP) is then disconnected from the surface wellhead and raised to provide access to the casing hanger. The casing hanger is then tensioned to the required load and depending on the distance from the support shoulder in the surface wellhead to the support surface of the nearest groove, an appropriate support ring is chosen and latched into the groove. A number of pre-manufactured support rings are preferably provided to allow the casing hanger to be adjusted to within a desired tolerance, for example one-half inch. The casing hanger is then landed in the wellhead and cut off at the required height. Any seals that may be desired or required are then installed between the casing hanger and the wellhead and fixed in place by suitable lock rings or similar means.

The inventive casing hanger design thus allows the seals to be installed by simply raising the BOP stack, rather than removing the BOP stack away from the well, which is a time consuming procedure. Also, since the load of the casing is transferred through the support ring, the seals may be replaced in the field without having to disturb the casing hanger tensioning. In addition, the casing hanger sealing surfaces are preferably pre-machined, which eliminates the need to field machine the casing hanger, a process which requires significant rig time and specialized machines and machinists. Furthermore, since the seal surfaces are recessed within the grooves, they are protected against damage from other components.

These and other objects and advantages of the present invention will be made apparent from the following detailed description, with reference to the accompanying drawings.

DETAILED DESCRIPTION OF THE PREFERRED EMBODIMENTS

Figure 1A:
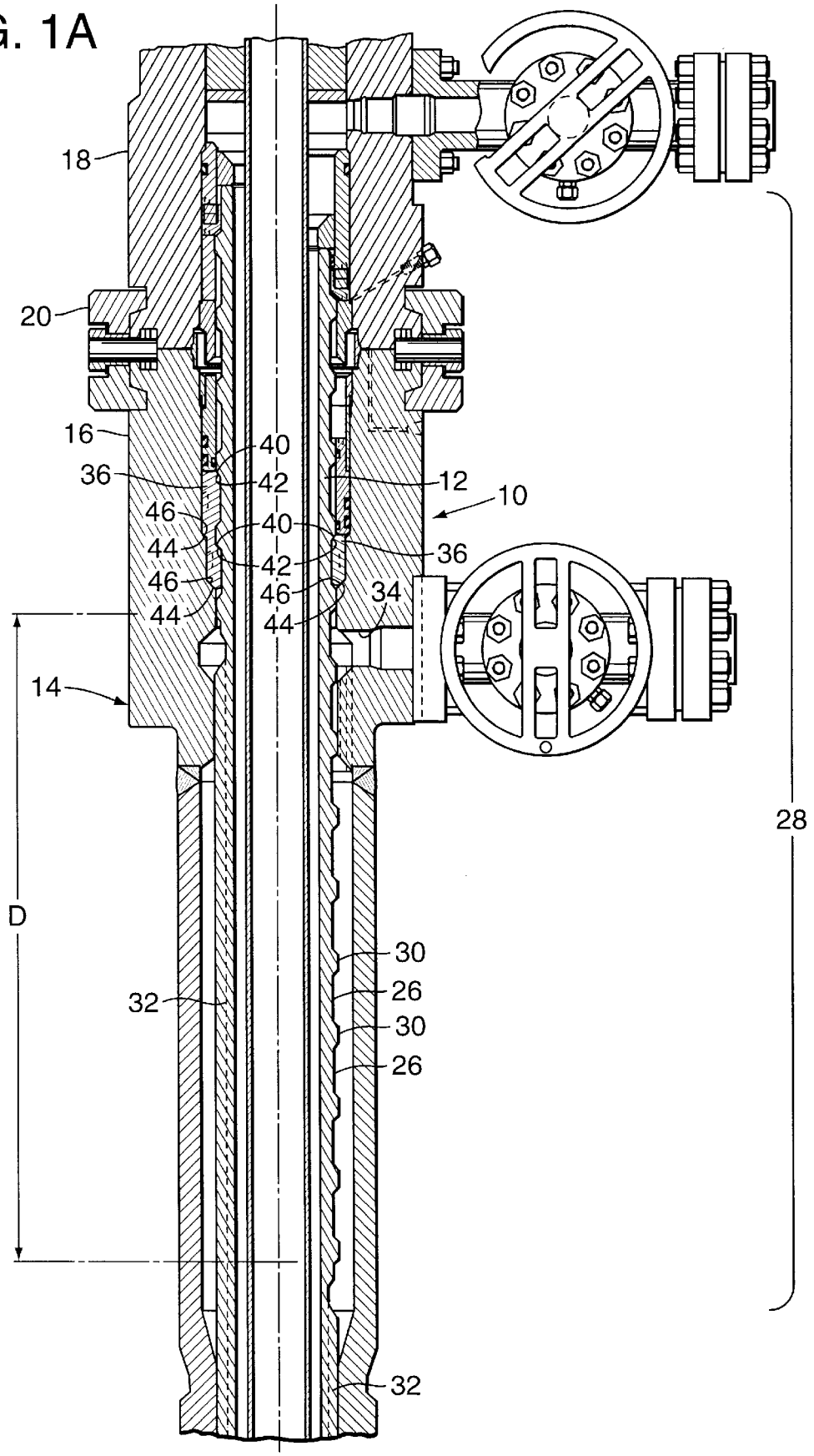
FIG. 1A is a longitudinal half section of the upper portion of an adjustable casing hanger of the present invention, the left-hand half of the figure showing the casing hanger in one possible adjustment position and the right-hand half of the figure showing the casing hanger in a second possible adjustment position.
Figure 1B:
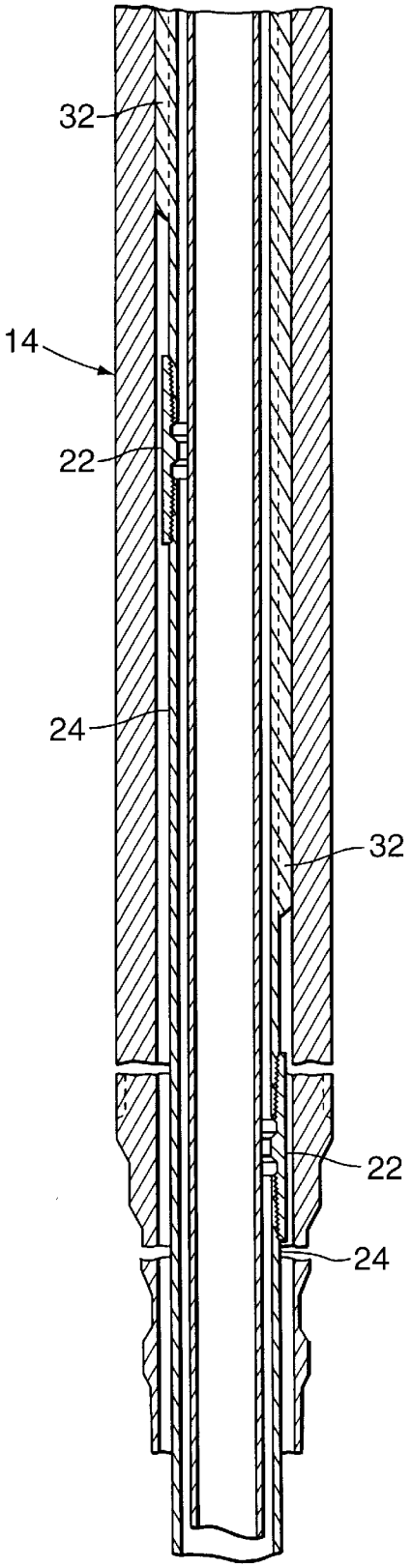
FIG. 1B is a longitudinal half section of the lower portion of the casing hanger depicted in FIG. 1A.

Referring to FIGS. 1A and 1B, the adjustable casing hanger of the present invention, indicated generally by reference number 10, comprises a tubular body portion 12 suspended within an exemplary surface wellhead 14, which in the Figures is depicted as comprising a casing head 16 attached to the platform of an offshore rig (not shown) and a tubing head 18 connected to the casing head 16 by suitable connector 20. A threaded coupling 22 (FIG. 1B) connects the lower end of the casing hanger body portion 12 to the upper end of a tieback casing string 24, which in turn is connected to a subsea wellhead (not shown).

A plurality of axial annular grooves 26 is formed in the outer diameter surface of the upper end portion 28 of the casing hanger body portion 12. The grooves 26 extend from proximate the upper end of the casing hanger body portion 12 to a point above the lower end thereof. The number and spacing of the grooves 26 determine the amount and degree of adjustment obtainable with the casing hanger 10, as will be described in more detail hereafter. In addition, the grooves 26 define ridges 30 on the outer diameter surface of the casing hanger body portion 12 which, among other functions, help to center the casing hanger 10 within the wellhead 14. Casing hanger body portion 12 also preferably includes a number of longitudinal slots 32 extending below the plurality of grooves 26 for communicating fluid between the casing hanger 10 and the wellhead 14 to an annulus port 34 in the wellhead 14.

Figure 2:
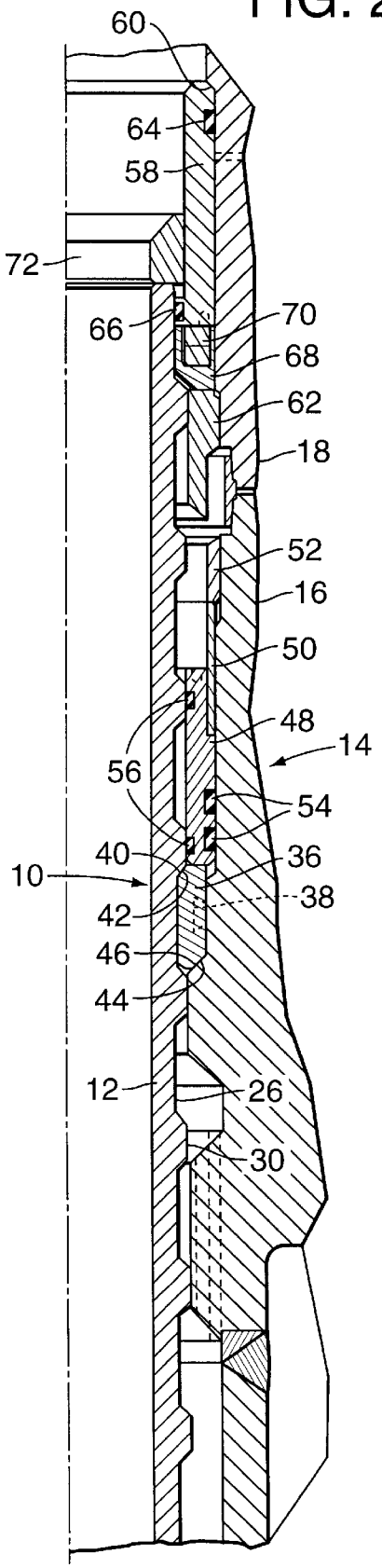
FIG. 2 is an enlarged longitudinal section of one half of the upper portion of the casing hanger depicted in the right-hand half of FIG. 1A.

Referring to FIG. 2, the casing hanger 10 also comprises a support ring 36 for transferring the load from the body portion 12 to the wellhead 14. The support ring 36 is comprised of preferably two pieces which are positioned in one or, depending on the specific design of the support ring employed, two of the grooves 26 and secured together by a latch 38 or similar means in a manner similar to that employed for conventional split rings. The support ring 36 comprises an upwardly facing load shoulder 40 for engaging a downwardly facing support surface 42 formed in each groove 26, and a downwardly facing load surface 44 for engaging an upwardly facing support shoulder 46 formed in the wellhead 14. In this manner, the casing hanger body portion 12, which comprises an outer diameter less than the minimum inner diameter of the wellhead 14, can be landed in the wellhead 14.

According to the present invention, the elevation, or vertical position, of the casing hanger body portion 12, and thus the tieback casing string 24, with respect to the wellhead 14 may be adjusted depending on the groove 26 into which the load ring 36 is positioned. For example, with reference again to FIGS. 1A and 1B, locating the support ring 36 in one of the upper grooves 26 (as shown in the right-hand half of FIG. 1A) will result in the casing hanger body portion 12 extending lower into the wellhead 14 than when the support ring 36 is positioned in one of the lower grooves 26 (as shown in the left-hand half of FIG. 1A). Consequently, the distance between the wellhead 14 and a subsea wellhead will be greater when the support ring is located in an upper groove than when the support ring is located in a lower groove. Depending on the number and size of the grooves 26, as well as the distance between the support shoulder 46 and the top of the casing head 16, the casing hanger body portion 12 may be adjusted a maximum distance D with respect to the wellhead 14 (see FIG. 1A). In one embodiment of the invention, fifteen grooves 26 spaced approximately five inches on center are machined into the outer diameter surface of the casing hanger body portion 12 to provide a maximum adjustment distance D of about forty-eight inches.

Furthermore, while the specific groove 26 into which the support ring 36 is placed will position the casing hanger body portion 12 within a desired distance with respect to the wellhead 14 (five inches in the above example), a number of pre-manufactured support rings each having a different vertical distance between the load shoulder and load surface may be provided to allow for precise adjustment of the body portion 12 within the wellhead 14. For instance, a sufficient number of pre-manufactured support rings may be provided to allow for adjustment of the casing hanger body portion 12 within one-half inch. The lefthand half of FIG. 1A depicts a second possible configuration of support ring 36 which has a greater distance between the upper load shoulder and the lower load surface than the load ring 36 depicted in the right-hand half of FIG. 1A. The left-hand half of FIG. 1A also shows that the support ring 36 may be configured with upper and lower portions positioned in successive grooves. In this embodiment, the support ring 36 comprises both upper and lower load shoulders 40 for engaging upper and lower support surfaces 42 in the successive grooves, and upper and lower support surfaces 44 for engaging upper and lower support shoulders 46 in the wellhead 14.

If desired, one or more seals may be provided to seal the annulus between the casing hanger body portion 12 and the wellhead 14. In the embodiment depicted in FIG. 2, a lower seal bushing 48 is positioned between the support ring 36 and a spacer ring 50, the later of which is held in place by a lower lock nut 52 which is threaded into the casing head 16. The lower seal bushing 48 includes a pair of outer annular seals 54 for sealing against the inner diameter of the casing head 16 and a pair of inner annular seals 56 for sealing against successive ridges 30 on casing hanger body portion 12. Also, an upper seal bushing 58 is positioned between a downwardly facing beveled surface 60 formed in the tubing head 18 and an upper lock nut 62 which is threaded into the tubing head 18 below the bevel 60. The upper seal bushing includes a seal 64 for sealing against the inner diameter of the tubing head 18 and a seal 66 for sealing against the casing hanger body portion 12. While the seals 54, 56, 64 and 66 are preferably elastomeric annular seals, such as O-rings, a metal seal may also be provided for sealing the annulus. Thus, a metal seal 68 may be provided between the upper lock nut 62 and the upper seal bushing 58 for sealing against a recess 26 and a sealing surface formed on the inner diameter of the tubing head 18. To facilitate proper sealing between the metal seal 68 and the recess 26, a sealing surface is machined into recess 26. In a preferred embodiment of the invention, a sealing surface is pre-machined into each recess 26 to eliminate the need to field machine such surfaces. An appropriate spacer 70 is positioned between the metal seal 68 and the upper seal bushing 58 to maintain the upper seal bushing against the bevel 60 and to energize the metal seal 68. In addition, a hold down nut 72 is threaded into the upper seal bushing 58 over the upper end of the casing hanger body portion 12 to restrict the vertical movement of the casing hanger 10 within the wellhead 14 due to thermal expansion.

During installation of the adjustable casing hanger 10 of the present invention, the casing hanger body portion 12 is made up to the top of the tieback casing string 24 and the assembly is lowered through the surface wellhead 14 until the bottom of the tieback casing string 24 engages and connects to the subsea casing string which is suspended within the subsea well (not shown). The blowout preventer or BOP (not shown) is then disconnected from the tubing head 18 and raised to provide access to the casing hanger body portion 12. The casing hanger is then tensioned to the required load and, depending on the distance from the support shoulder 46 in the casing head 16 to the support surface 42 of the nearest groove 26, an appropriate support ring 36 is chosen and latched into the groove. The casing hanger is then landed in the wellhead and cut off just above the top of the casing head 16. Any seals that may be desired or required are then installed between the casing hanger and the wellhead and fixed in place by the spacer rings and lock nuts described above.

It should be recognized that, while the present invention has been described in relation to the preferred embodiments thereof, those skilled in the art may develop a wide variation of structural details without departing from the principles of the invention. Therefore, the appended claims are to be construed to cover all equivalents falling within the true scope and spirit of the invention.

What is claimed is:

1. An adjustable casing hanger for suspending a casing string from a wellhead which comprises:

an elongated tubular body having a lower end adapted to be connected to the casing string and an upper end portion comprising a plurality of axial annular grooves formed in the outer diameter surface thereof;

each groove defining a downwardly facing support surface; and a support ring adapted to be positioned around the body in one of the grooves, the support ring having an upwardly facing load shoulder for engaging the support surface and a downwardly facing load surface for engaging a support shoulder formed in the wellhead;

whereby the elevation of the casing hanger within the wellhead can be adjusted depending on in which groove the support ring is positioned.

2. The casing hanger of claim 1, further comprising a sealing surface pre-machined into each of a number of the grooves.

3. An adjustable hanger for suspending a casing string from a wellhead having at least a first generally upwardly facing annular support shoulder, the adjustable hanger comprising:

an elongated tubular body having an outer diameter surface, a first end comprising means for connecting the body to the casing string, and at least two axially-spaced, annular grooves formed in the outer diameter surface above the first end;

wherein each of the grooves defines a generally downwardly facing annular support surface on the body;

an annular support ring having at least one generally upwardly facing load shoulder and at least one generally downwardly facing load surface;

wherein the support ring is positioned in at least one of the grooves such that at least one of the load shoulders engages at least one of the support surfaces and at least one of the load surfaces engages the support shoulder to thereby support the casing string within the wellhead;

whereby the axial position of the casing string within the wellhead can be adjusted depending on the groove in which the support ring in positioned.

4. The adjustable hanger of claim 3, wherein the support ring comprises one load shoulder and one load surface, and the support ring is positioned within one of the grooves.

5. The adjustable hanger of claim 3, wherein the support ring comprises two load shoulders and one load surface, and the support ring is positioned in two of the grooves.

6. The adjustable hanger of claim 5, wherein the wellhead comprises a second generally upwardly facing annular support shoulder, the support ring comprises two load surfaces, the support ring is positioned in two of the grooves and the two load surfaces engage the first and second support shoulders.

7. The adjustable hanger of claim 3, wherein each groove defines an annular recess in the outer diameter surface of the body, at least one recess comprises a sealing surface, and the adjustable hanger further comprises a seal for sealing between the wellhead and the sealing surface.

* * * * *